US005990408A

United States Patent [19]

Hasebe

[11] Patent Number: 5,990,408

[45] Date of Patent: Nov. 23, 1999

[54] ELECTRONIC STRINGED INSTRUMENT USING PHASE DIFFERENCE TO CONTROL TONE GENERATION

[75] Inventor: Kiyoshi Hasebe, Shizuoka-ken, Japan

[73] Assignee: Yamaha Corporation, Hamamatsu, Japan

[21] Appl. No.: 08/812,009

[22] Filed: Mar. 5, 1997

[30] Foreign Application Priority Data

Mar. 8, 1996 [JP] Japan ..... 8-079359

[51] Int. Cl.[6] ..... G10H 3/00

[52] U.S. Cl. ..... 84/723; 84/735

[58] Field of Search ..... 84/723, 726–728, 84/735

[56] References Cited

U.S. PATENT DOCUMENTS 4,348,930 9/1982 Chobanian et al. ..... 84/726
4,907,483 3/1990 Rose et al. ..... 84/726
5,206,449 4/1993 McClish ..... 84/723
5,585,588 12/1996 Tumura ..... 84/726

FOREIGN PATENT DOCUMENTS 55-87196 7/1980 Japan .
9516984 6/1996 WIPO .

*Primary Examiner*—Jeffrey Donels
*Attorney, Agent, or Firm*—Pillsbury Madison & Sutro LLP

[57] ABSTRACT

An electronic stringed instrument having a first pickup device and a second pickup device. When any one of the strings is picked at a picking position between the first pickup device and the second pickup device, vibrational waves propagate from the picking position toward both sides of the string. When the advancing waves pass the first and second pickup devices, the first and second pickup devices output electrical signals. A time difference between the electrical signals provided by the first and second pickup devices is calculated to determine the picking position. Note tone color and other tonal parameters are controlled based on the picking position.

28 Claims, 5 Drawing Sheets

ELECTRONIC STRINGED INSTRUMENT USING PHASE DIFFERENCE TO CONTROL TONE GENERATION

BACKGROUND OF THE INVENTION

1. Field of the Invention

Embodiments of the present invention relate to a stringed instrument type electronic musical instrument (hereinafter referred to as an electronic stringed instrument) in which the string vibrations are converted to electrical signals and tones are generated based on the electrical signals. More particularly, embodiments of the present invention relate to a guitar synthesizer.

2. Description of Related Art

A typical electronic musical instrument in the form of a stringed instrument has strings. The electronic musical instrument of this type has a pickup device that detects string vibration and converts the vibration to electrical signals. The electronic musical instrument further includes an analog-to-digital converter that converts the electrical signals to digital signals that are digitally processed. The electronic musical instrument generates various musical tone data including data for pitch of each of the electrical signals, data for an envelope of vibration of each of the strings, data for starting time and attenuation of vibration of each of the strings and the like, based on the corresponding digital signals. Tones are generated based on the detected musical tone data. For example, such an electronic musical instrument is currently sold as a guitar synthesizer.

In the manner described above, a pitch and an envelope of each of the strings of the guitar synthesizer are detected and a musical tone is generated based on the detected pitch and envelope. Although the pitch and the envelope are typical parameters of string vibration, the guitar's original expression cannot be created merely by the pitch and the envelope of string vibration. In other words, the detected pitch and envelope alone do not generate a tone that is characteristic of the guitar.

For example, it is appreciated that a tone color generated by a string of the guitar varies depending upon where the string is picked. The closer to the bridge of the guitar a player picks the string, the more higher level overtones are generated, with the result that the tone color becomes "harder". On the other hand, the closer to the central area of the string and the farther from the bridge a player picks the string, the fewer higher level overtones are generated, with the result that the tone color becomes "soft". A tone generated based on the detected pitch and envelope alone does not reflect these characteristic features of the guitar.

Other conventional pitch detection methods are also used for detecting a pitch representative of a frequency of string vibration. For example, in the zero-cross detection method, the position at which an amplitude value of a waveshape intersects with a reference level value (the zero-cross point) is detected, and a time separation between two zero-cross points that corresponds to a cycle of the waveshape is measured. In still other conventional pitch detection methods, a cycle of a waveshape is obtained by calculating a self-correlation function of the waveshape, or by detecting a separation between peak values of the waveshape.

The above-described pitch detecting methods have both advantages and disadvantages. For example, when a string of a guitar is picked, the string starts vibrating. It is appreciated that the vibration of the string typically has a complicated waveshape during a period immediately after the string is picked. This starting period of the waveshape is called an attack portion and contains many higher level overtones. Therefore, it is difficult to detect the correct pitch during the attack portion and an erroneous pitch detection often occurs if pitch is detected during the attack portion.

In order to prevent an erroneous pitch detection, pitch detection may be delayed until the waveshape stabilizes to a specified level. However, in this case, since a pitch is not detected for some time after the string is picked, generation of a tone is delayed. As a result, a performer may feel that the tone generation is disordered and the delayed tone generation may adversely interfere with musical performance of the performer. For example, Japanese Laid-open Patent Application SHO 55-87196 describes a pitch detection method in which key-on data is outputted only when the same pitch is detected in two cycles. As a result, generation of a tone is delayed.

SUMMARY OF THE INVENTION

It is an object of embodiments of the present invention to provide an electronic stringed instrument that varies tone colors depending on locations at which the strings are picked.

Also, it is another object of embodiments of the present invention to provide an electronic stringed instrument that performs correct, prompt pitch detection.

In accordance with an embodiment of the present invention, an electronic stringed instrument includes at least two pickup devices for each string that detect vibration of the string at two locations and convert the vibration to electric signals, a phase difference detection device that detects a phase difference between the electric signals outputted by the at least two pickup devices, and a musical sound controlling device that controls tones in accordance with the phase difference detected by the phase difference detection device.

An electronic stringed instrument, in accordance with another embodiment of the present invention, includes at least two pickup devices provided for each string that detect vibration of the string at two locations and convert the vibration to electric signals, and at least two pitch detection devices that detect at least two pitch data sets based on the electric signals outputted by the at least two pickup devices. When the detected pitch data sets are substantially equal to each other, the at least two pitch detection devices output either of the pitch data sets. When detected pitch data sets are not equal to each other, the at least two pitch detection devices output one of the pitch data sets that is considered to be more accurate than the other under a given environment in which the pickup devices are positioned with respect to other instrument components. Alternatively, when detected pitch data sets are not equal to each other, the at least two pitch detection devices output one of the pitch data sets detected by one of the pickup devices that is considered to provide more accurate pitch data under a predetermined condition in which the pickup devices are disposed in the electronic stringed instrument. A tone is generated based on the outputted pitch data set.

In accordance with embodiments of the present invention, picking positions at which a string is picked are detected and tones are controlled based on the picking positions. Accordingly, tone variation that is caused by picking a string at different locations is reflected in tone generation. In other words, a performer can change the tone color of a tone of a string by changing picking positions at which the string is picked.

Also, in accordance with embodiments of the present invention, a pitch is detected based on electrical signals provided by at least two pickup devices. As a result, the deficiencies of the conventional pitch detection methods are substantially eliminated and correct, prompt pitch detection is realized.

Other features and advantages of the invention will be apparent from the following detailed description, taken in conjunction with the accompanying drawings which illustrate, by way of example, various features of embodiments of the invention.

BRIEF DESCRIPTION OF THE DRAWINGS

A detailed description of embodiments of the invention will be made with reference to the accompanying drawings.

EMBODIMENTS OF THE PRESENT INVENTION

Figure 1:
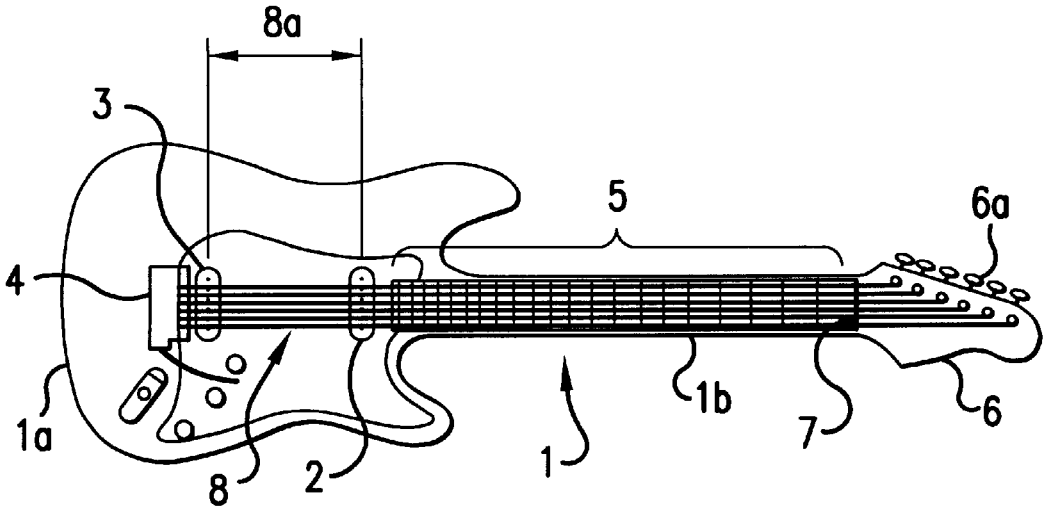
FIG. 1 shows an exterior view of an electronic stringed instrument in accordance with an embodiment of the present invention which is implemented in a guitar synthesizer.

FIG. 1 shows an overall view of a guitar synthesizer 1 that is an electronic stringed instrument in accordance with one embodiment of the present invention.

Referring to FIG. 1, the guitar synthesizer 1 has a first pickup device 2 and a second pickup device 3. The first pickup device 2 is disposed away from a bridge 4 for detecting waveforms of vibration of six strings 8 and outputting corresponding electrical signals. The second pickup device 3 is disposed adjacent the bridge 4 for detecting waveforms of vibration of the six strings 8 and outputting corresponding electrical signals.

The bridge 4 supports one end of each of the six strings 8 on a body 1*a* of the guitar synthesizer 1. Frets 5 are formed on a neck portion 1 b of the guitar synthesizer 1 for controlling scale tones. A head 6 includes tuning pegs 6*a* that are used to adjust tension of the six strings 8 to tune the six strings 8. A nut 7 is provided between the neck portion 1*b* and the head 6 for supporting the other ends of the strings 8 on the guitar synthesizer 1.

The guitar synthesizer 1 has a picking area (or a strumming area) 8*a* in which the strings 8 are normally picked. The picking area 8*a* is defined between the first pickup device 2 and the second pickup device 3 as shown in FIG. 1. In accordance with one embodiment of the present invention, when the strings 8 are picked within the picking area 8*a*, picking position is detected.

In accordance with one embodiment of the present invention, a picking position is detected in the following manner. When any one of the strings 8 is picked at one position, the string 8 generates a vibrational waveform. The vibrational waveform propagates at a predetermined propagation speed from the position at which the string 8 is picked toward both ends of the string 8. When the vibrational waveform reaches the first pickup device 2, the first pickup device 2 outputs an electrical signal. When the vibrational waveform reaches the second pickup device 3, the second pickup device 3 outputs an electrical signal. In this case, the time when the electrical signals are outputted from the first pickup device 2 and the second pickup device 3 is determined by separations between the picking position, the first pickup device 2 and the second pickup device 3. In other words, one of the pickup devices that is closer to the picking position outputs an electrical signal earlier than the other because the vibrational waveform propagates through a shorter distance. The other of the pickup devices, that is farther from the picking position, outputs an electrical signal later than the other because the vibrational waveform propagates through a longer distance.

In one embodiment, a phase difference between a phase of the electrical signal outputted from the first pickup device 2 and a phase of the electrical signal outputted from the second pickup device 3 is detected. The picking position between the first pickup device 2 and the second pickup device 3 is calculated based on the phase difference so that the guitar synthesizer 1 detects a picking position of each of the strings 8.

A pitch detection device (which will be described later in greater detail) detects pitches of the vibrational waveforms of the string 8 based on the electrical signals outputted from the first pickup device 2 and the second pickup device 3 and generates first and second pitch data sets representative of the pitches detected by the first pickup device 2 and the second pickup device 3, respectively. The first pitch data set and the second pitch data set are compared with each other. When the first pitch data set and the second pitch data set are equal to each other, each of the first pitch data set and the second pitch data set is considered to be a correct pitch. Alternatively, the first pitch data set is compared with the second pitch data set. When the first and the second pitch data sets are equal to each other, the first pitch data set is outputted as a correct pitch. When the first and the second pitch data sets are not equal to each other, one of the two pitch data sets is outputted as a correct pitch data set. Here, one of the two pitch data sets is considered as a correct pitch data set based on a given condition in which the pickup devices 2 and 3 are disposed with respect to other guitar synthesizer components, such as the strings 8, the bridge 4 and the like. This is because the pickup device which provides an electrical signal that represents a more accurate pitch than the other is generally determined by the given condition in which the pickup devices 2 and 3 are disposed with respect to the other guitar synthesizer components. For example, in the illustrated embodiment shown in FIG. 1, the first pickup device 2 is positioned away from the bridge 4, and the second pickup device 3 is positioned relatively close to the bridge 4. In this case, the first pickup device 2 tends to output an electrical signal that contains less overtone components, compared with an electrical signal outputted by the second pickup device 3. As a result, when a pitch is detected based on an electrical signal outputted from the first pickup device 2, probability of error pitch detection could be lower.

Therefore, in a preferred embodiment, when two pitch data sets are not equal to each other, one of two pitch data sets representative of an electrical signal detected by the first pickup device 2 that is located away from the bridge 4 is outputted. In another embodiment, outputting a pitch data set is delayed until the same pitch data set is detected at least twice. The former pitch detection method is used in a speed priority mode in which the priority is placed more on the speed of outputting a pitch data. The later pitch detection method is used in an accuracy priority mode in which the priority is placed more on the accuracy of a pitch data to be outputted.

Figure 3:
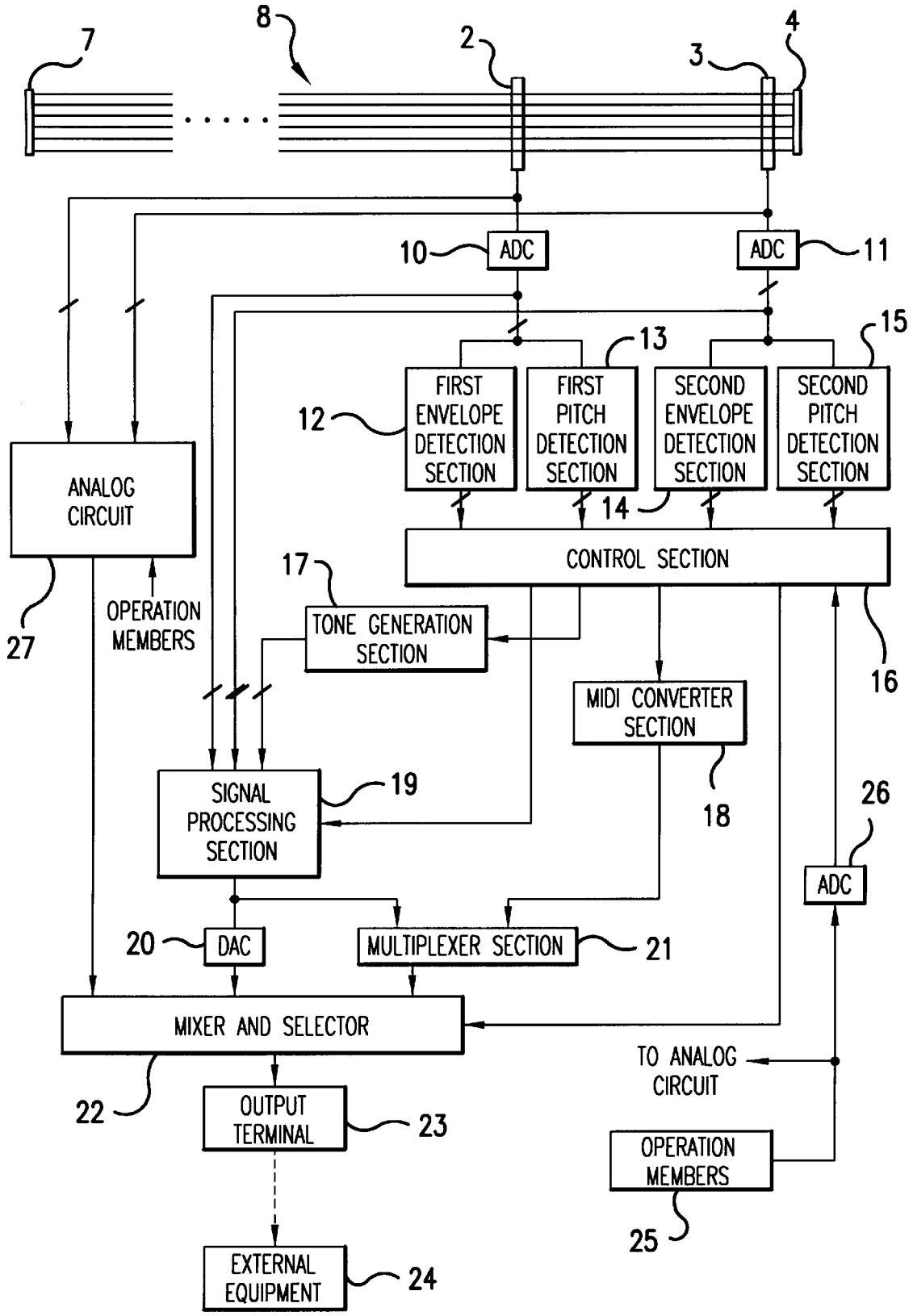
FIG. 3 shows a block diagram of an electric circuit of an electronic stringed instrument in accordance with an embodiment of the present invention.
Figure 4A:
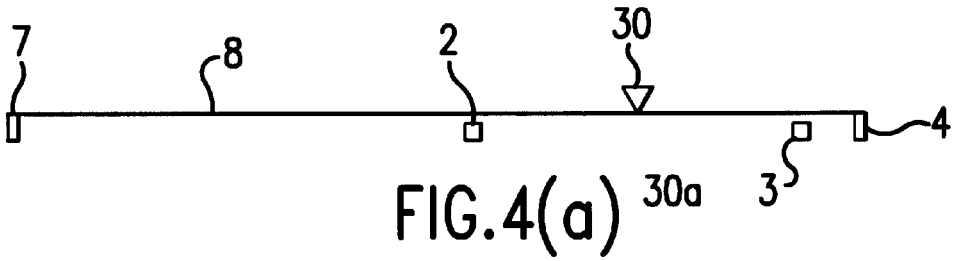
FIGS. 4(*a*)–4(*e*) schematically show strings in an electronic stringed instrument that are picked at different positions and waveshapes that propagate in the strings in accordance with an embodiment of the present invention.
Figure 4B:
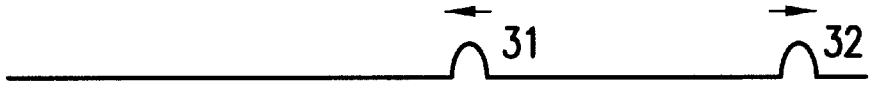
Figure 4C:
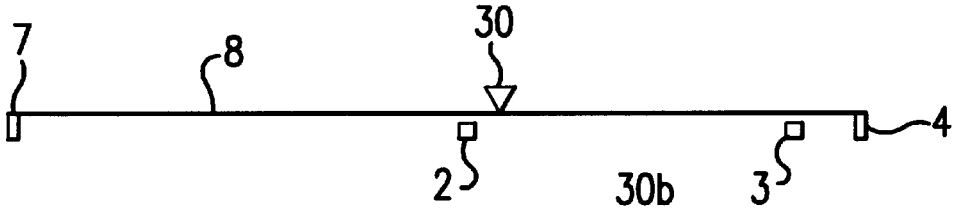
Figure 4D:
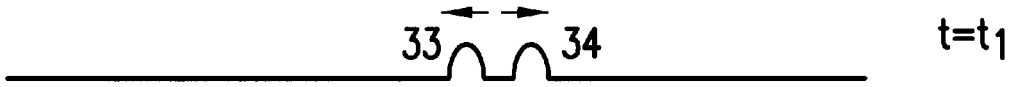
Figure 4E:
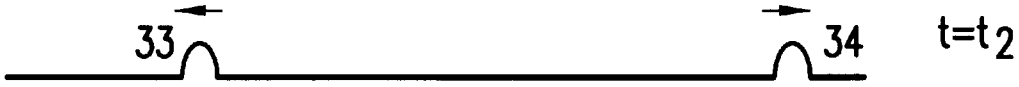

FIG. 3 shows a block diagram of an electrical circuit of an electronic stringed instrument in accordance with one embodiment of the present invention. The electric circuit is mounted within the guitar synthesizer 1 shown in FIG. 1. In an alternative embodiment, the electric circuit may be separated from the guitar synthesizer 1, that is mounted within an external piece of equipment. In an alternative embodiment, the guitar synthesizer 1 may be connected to a personal computer so that the tone generation for the guitar synthesizer 1 is additionally or independently controlled by the personal computer or a program stored in a machine-readable media, such as, for example, a ROM (read only memory), a RAM (random access memory), a hard drive, a CDROM (compact disc read only memory), a DVD (digital video disc) or the like. In one embodiment, the tone generation for the guitar synthesizer 1 that is performed by the electrical circuit shown in FIG. 3 may be performed by instructions stored in a machine-readable media.

In FIG. 3, six horizontal lines represent portions of the strings 8 of the guitar synthesizer 1 shown in FIG. 1. The six strings 8 are stretched between the bridge 4 and the nut 7, and vibrate between two fixed ends defined by the bridge 4 and the nut 7. In the illustrated embodiment, the second pickup device 3 is disposed adjacent the bridge 4, and the first pickup device 2 is disposed away from the bridge 4.

In a preferred embodiment, each of the first pickup device 2 and the second pickup device 3 detects vibration of each of the strings 8 and generates an electrical signal representative of the vibration for each of the strings 8.

Electrical signals outputted from the first pickup device 2 are converted to respective digital signals by an analog-to-digital converter (ADC) 10, multiplexed and supplied to a first envelope detection section 12 and a first pitch detection section 13.

Electrical signals outputted from the second pickup device 3 are converted to respective digital signals by an analog-to-digital converter (ADC) 11, multiplexed and supplied to a second envelope detection section 14 and a second pitch detection section 15.

First envelope data sets detected by the first envelope detection section 12, first pitch data sets detected by the first pitch detection section 13, second envelope data sets detected by the second envelope detection section 14 and second pitch data sets detected by the second pitch detection section 15 are supplied to a control section 16.

The control section 16 executes a picking position detection process to determine picking positions for the six strings 8, using the first envelope data sets and the second envelope data sets.

The first pitch data sets and the second pitch data sets are supplied together with picking position data sets representative of the respective detected picking positions to a tone control section (which will be described later in greater detail) that is built in the control section 16. The tone control section determines correct pitch data sets based on the corresponding first pitch data sets and second pitch data sets, and outputs tone control data sets based on the detected picking position data sets and the determined pitch data sets.

The tone control data sets are supplied to a tone generation section 17 and a signal processing section 19. The control section 16 calculates tone data sets based on the determined pitch data sets and outputs the detected picking position data sets and the tone data sets to a MIDI converter section 18.

The tone generation section 17 generates tone data sets for tones respectively having specified pitches and tone colors respectively defined based on the supplied tone control data sets, and supplies the tone data sets to the signal processing section 19. The tone generation section 17 generates tone data according to any appropriate tone generation method, such as, for example, a waveshape memory read-out method, a frequency modulation method or a sine wave synthesizing method. The tone generation section 17 may generate a plurality of tones by employing a time division method. In a preferred embodiment, since each of the first pickup device 2 and the second pickup device 3 provides six outputs, in other words, the first pickup device 2 and the second pickup device 3 provide twelve outputs in total, at least twelve tone generation channels are provided so that twelve different tones can be simultaneously and independently generated.

The control section 16 provides the tone control data sets that are required for tone generation and tone control to the MIDI converter section 18. The MIDI converter section 18 converts the tone control data sets to MIDI signals that comply with the MIDI standard.

The signal processing section 19 receives a total of twelve digital signals from the analog-to-digital converter (ADC) 10 and the analog-to-digital converter (ADC) 11, and twelve tone signals from the tone generation section 17. The control section 16 outputs control signals to the signal processing section 19. The control signals are used for adding various sound effects to the twenty-four tone signals, such as, for example, reverberation and the like, and for executing selection control on the twenty-four tone signals. In one embodiment, different sound effects may be independently added to the respective twenty-four signals. In an alternative embodiment, instead of independently adding different sound effects to the respective twenty-four signals, the twenty-four tone signals may be divided into a plurality of groups, and different sound effects are added to the respective groups.

Further, the signal processing section 19 is capable of performing a variety of other controls. For example, the signal processing section 19 outputs electrical signals that are provided through the analog-to-digital converter (ADC) 10 and the analog-to-digital converter (ADC) 11 from the first pickup device 2 and the second pickup device 3 or tone signals provided from the tone generation section 17 without adding any effects to these signals, or mixes these signals. The signal processing section 19 eventually outputs, for example, six digital signals.

A digital-to-analog converter (DAC) 20 converts the six outputs from the signal processing section 19 into analog signals, mixes the analog signals into a single analog signal and outputs the single analog signal to a mixer and selector 22. Also, the six outputs from the signal processing section 19 are multiplexed with the MIDI signal supplied from the MIDI converter section 18 by a multiplexer section 21 and outputted to the mixer and selector 22. Therefore, the multiplexer section 21 outputs multiplexed data of six digital signals and one MIDI signal.

Six electrical signals outputted from each of the first pickup device 2 and the second pickup device 3 are supplied as analog tone signals to an analog circuit 27 that processes analog signals. In this embodiment, the guitar synthesizer 1 includes a group of operation members 25 mounted on the body 1*a* of the guitar synthesizer 1. The operation members 25 are operated by a performer to provide outputs to the analog circuit 27 to control analog tones.

The analog circuit 27 processes analog signals in response to operating positions of the operation members 25. The analog circuit 27 includes analog devices, such as, for example, analog filters, an analog loudness controller, an analog mixing circuit, and the like, that are controlled by the operation members 25. As a result, various functions of an ordinary electric guitar, such as, for example, tone control, loudness control, pickup balance control, and the like are performed.

A single analog tone signal thus produced by the analog circuit 27 is supplied to the mixer and selector 22.

Also, outputs from the group of operation members 25 are converted to digital signals by an analog-to-digital converter (ADC) 26 and inputted in the control section 16, so that a performer can command the control section 16 to perform a variety of controls over tone generation and guitar performance.

The mixer and selector 22 selects one of the output of the analog circuit 27, the output of the digital-to-analog converter 20 and the output of the multiplexer section 21 and outputs the selected output to an output terminal 23. The output terminal 23 may be formed from a standard jack that is generally used in an ordinary electric guitar. In this case, an ordinary shielded wire can be used for connecting the guitar synthesizer 1 and a piece of external equipment 24.

The external equipment 24 includes a guitar amplifier, an effector, a mixer, a recording apparatus, a MIDI equipment and the like. An appropriate type of equipment is selected for the external equipment 24 so that the external equipment 24 is suited to tone signals selected by the mixer and selector 22. For example, when the output from the multiplexer section 21 is selected, an analog effector cannot be used. On the other hand, when the output from the analog circuit 27 is selected, a MIDI equipment cannot be used.

When MIDI equipment is connected to the output terminal 23 of the guitar synthesizer 1, the MIDI signal in the multiplexed signal has to be separated from the six digital tone signals, and the separated MIDI signal needs to be inputted to the MIDI equipment. In this case, the separated digital tone signals are inputted to a digital mixer, a digital recorder, a digital effector, and the like.

The mixer and selector 22 is capable of mixing a plurality of inputted signals to form a mixed signal. The mixed signal is transmitted through the output terminal 23 to the external equipment 24. In this case, the external equipment 24 separates the mixed signal into a plurality of signals and the separated signals are used for musical performance.

Next, a method of detecting picking positions at which the strings 8 are picked will be described with reference to FIGS. 4 and 5.

FIG. 4 (*a*) schematically shows a side view of the bridge 4, the second pickup device 3, the first pickup device 2, the string 8, and the nut 7 of the guitar synthesizer 1 shown in FIG. 1. It is noted that only one of the strings 8 is shown in FIG. 4 (*a*) for convenience of description.

As shown in FIG. 4 (*a*), the string 8 is picked by a pick 30 at a picking position 30*a*. In this case, the picking position 30*a* is located generally intermediate between the first pickup device 2 and the second pickup device 3. The string 8 vibrates as the string 8 is picked by the pick 30 and generates waves advancing toward both sides of the string 8, namely, an advancing wave 31 shown in FIG. 4 (*b*) that advances from the picking position 30*a* to the left and an advancing wave 32 shown in FIG. 4 (*b*) that advances from the picking position 30*a* to the right. As shown in FIG. 4 (*b*), when these advancing waves reach the first pickup device 2 and the second pickup device 3, respectively. The first pickup device 2 and the second pickup device 3 convert the respective advancing waves into electrical signals having corresponding voltage variations. In this case, the first pickup device 2 and the second pickup device 3 detect the advancing waves at substantially the same time because the picking position 30*a* is located generally intermediate the first pickup device 2 and the second pickup device 3.

Next, let us assume that the string 8 is picked by the pick 30 at a picking location 30*b* shown in FIG. 4 (*c*) in which the picking position 30*b* is closer to the first pickup device 2 than to the second pickup device 3. When the string 8 is picked by the pick 30, the string 8 vibrates and generates waves advancing toward both sides of the string 8, in other words, an advancing wave 33 that advances from the picking position 30*b* to the left and an advancing wave 34 that advances from the picking position 30*b* to the right.

In the above-described case, the first pickup device 2 detects the advancing wave 33 at time t1, substantially immediately after the string 8 is picked, as shown in FIG. 4 (*d*). However, the second pickup device 3 detects the advancing wave 34 only at time t2 that is later than time t1 shown in FIG. 4 (*e*).

In this manner, the first pickup device 2 and the second pickup device 3 detect advancing waves at different times depending on picking positions. In other words, a picking position is determined based on a detection time difference (t2−t1) between the times detected respectively by the first pickup device 2 and the second pickup device 3.

The advancing waves that advance toward both ends of the string 8 are reflected at the fixed ends defined by the nut 7 and the bridge 4, and advance toward the opposite ends of the string 8. In this manner, the advancing waves are repeatedly reflected at the fixed ends, with the result that a standing wave is generated.

Also, it is appreciated that the speed of an advancing wave that propagates through the string 8 is determined by the linear density and tension of the string 8. A guitar normally has six strings having different diameters and different tensions as the strings are tuned. Therefore, advancing waves propagate through the six strings at different speeds. As a result, even when the strings are picked at the same location, a time difference between advancing waves that reach the first pickup device 2 and the second pickup device 3 is different from one string to another. Accordingly, different time difference-picking position conversion tables are required for the respective strings.

Figure 5:
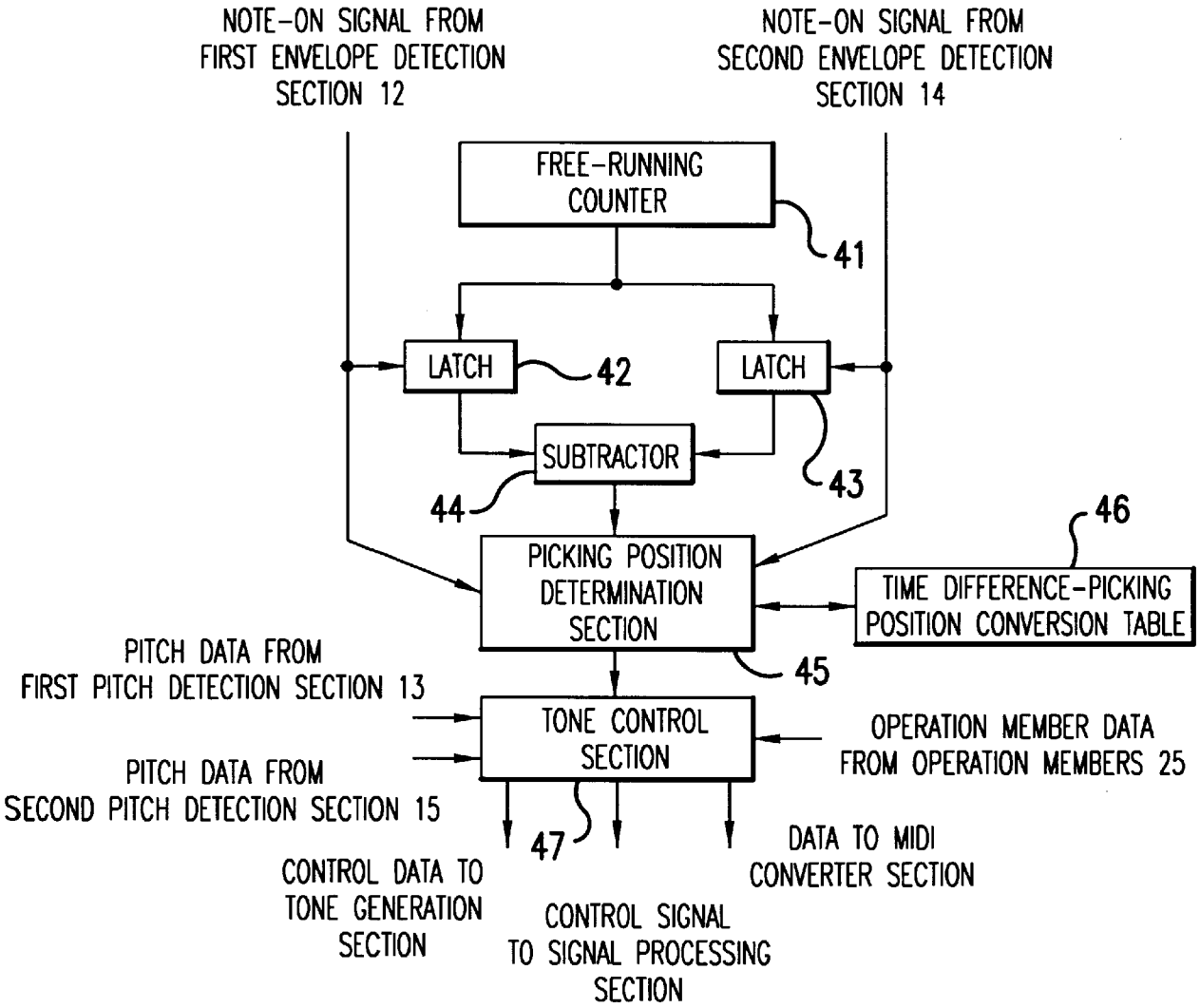
FIG. 5 shows a block diagram of a control section in an electronic stringed instrument in accordance with an embodiment of the present invention.

FIG. 5 shows a block diagram of an electrical circuit that executes the above-described method for detecting picking positions. In a preferred embodiment, the electrical circuit shown in FIG. 5 is implemented in the control section 16.

As shown in FIG. 5, a first envelope detection section 12 supplies a note-on signal as a strobe signal to a latch 42. The note-on signal is generated when envelope data, that is formed by connecting peak values of an advancing wave detected by the first pickup device, exceeds a predetermined threshold value. When the envelope data becomes smaller than the predetermined threshold value, a note-off signal is generated. In a similar manner, a second envelope detection section 14 supplies a note-on signal as a strobe signal to a latch 43.

A free-running counter 41 supplies counting values to the latch 42 and the latch 43. When note-on signals are inputted in the latches 42 and 43, the latches 42 and 43 latch respective counting values that have been supplied. Then, a subtracter 44 calculates a difference between the latched counting values provided by the latches 42 and 43. It is noted that a subtraction value is defined by a difference between the counting values outputted from the subtracter 44 and corresponds to a detection time difference between the first pickup device 2 and the second pickup device 3.

The subtraction value outputted from the subtracter 44 is inputted in a picking position determination section 45 to determine a picking position. The picking position determination section 45 uses a time difference-picking position conversion table 46 prepared for each of the strings 8 to determine the picking position.

Figure 2:
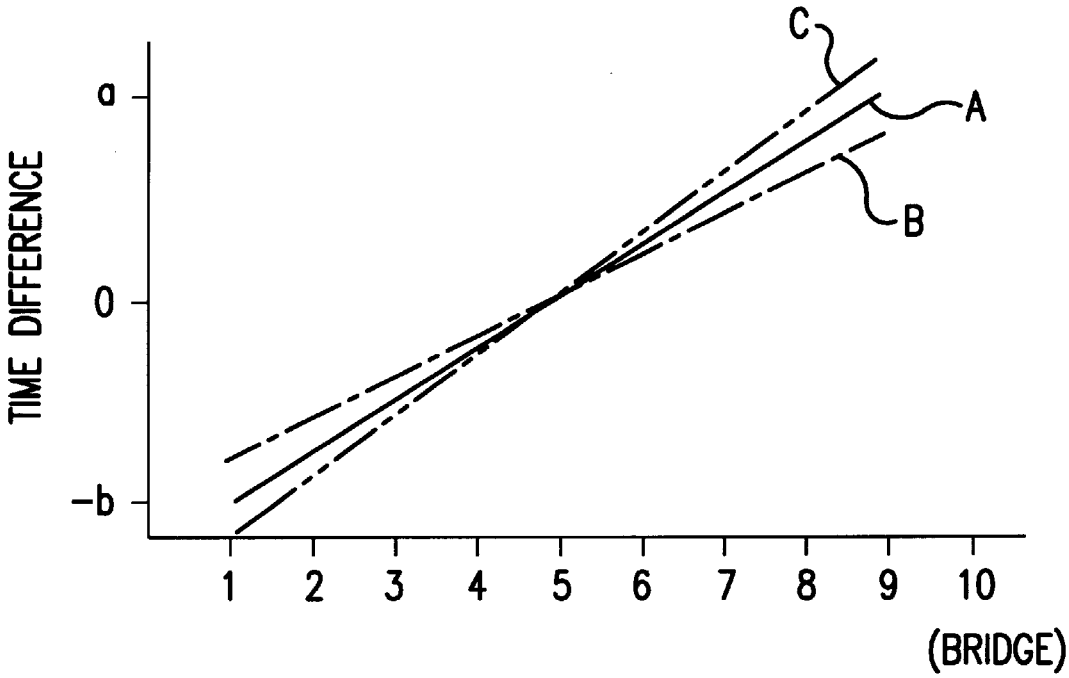
FIG. 2 shows characteristics of time difference vs picking position conversion tables that are referred to by a picking location determination section in accordance with one embodiment of the present invention.

FIG. 2 shows an example of a time difference-picking position conversion characteristic for a string (indicated by a solid line A) that is stored in the time difference-picking position conversion table 46, where a horizontal axis represents picking positions across the picking area 8*a* and a vertical axis represents time differences. When a string has a greater tension than the string having the characteristic indicated by the solid line A, propagation speed of advancing waves is greater and a time difference between the advancing waves is smaller. For example, such a string has a time difference-picking position conversion characteristic having a gentler inclination (indicated by a dash-and-dot line B). When a string has a smaller tension than the string having the characteristic represented by the solid line A, the propagation speed of advancing waves is smaller and a time difference between the advancing waves is greater. For example, such a string has a time difference-picking position conversion characteristic having a steeper inclination (indicated by a dash-and-two-dots line C).

Picking position data is determined based on the time difference-picking position conversion table prepared for each of the strings 8 and supplied to a tone control section 47.

The tone control section 47 also receives pitch data detected by the first pitch detection section 13, pitch data detected by the second pitch detection section 15 and operation member data outputted from the group of operation members 25. The tone control section 47 determines pitch data based on the two pitch data and generates control data required for generating and controlling tones based on the determined pitch data, the picking position data and the operation member data.

The generated control data is supplied to the tone generation section 17 and the signal processing section 19 to control these sections 17 and 19 in the manner described above. Also, the tone control section 47 supplies control data required for generating and controlling tones to the MIDI converter section 18.

Figure 6:
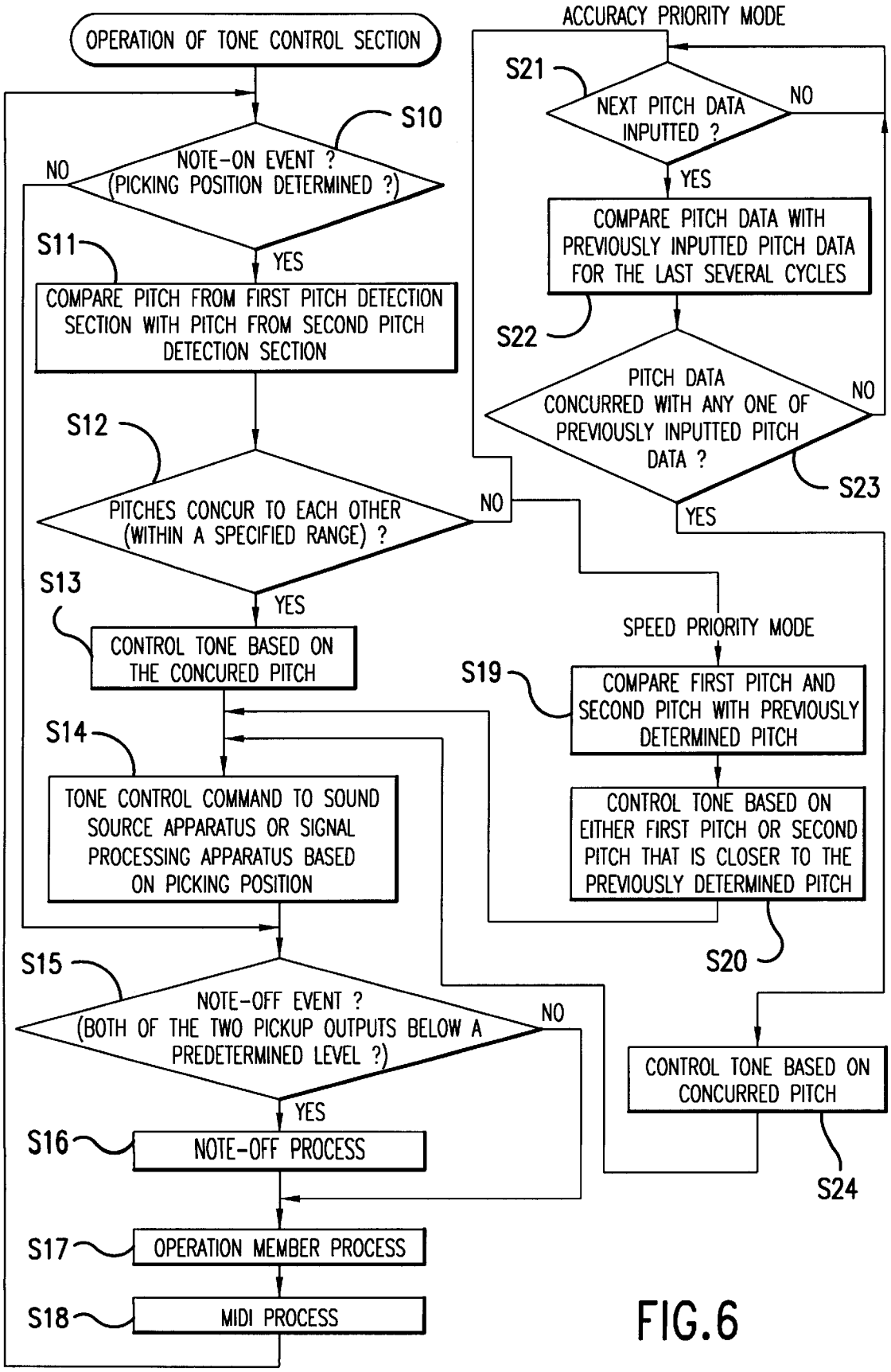
FIG. 6 shows a flow chart of an operation of a tone control section in an electronic stringed instrument in accordance with an embodiment of the present invention.

Next, an operation of the tone control section 47 will be described in detail with reference to the flow chart shown in FIG. 6.

When an operation by the tone control section 47 is started, a determination is made in step S10 as to whether a note-on event occurs. The determination for a note-on event is made by determining as to whether a picking position is determined. As described above, a note-on signal is used as a strobe signal for determining a picking position. Therefore, when a picking position is determined, a note-on event has occurred.

When the picking position determination section 45 outputs picking position data, a determination "Yes" is made in step S10, and a first pitch data set outputted by the first pitch detection section 13 and a second pitch data set outputted by the second pitch detection section 15 are compared with each other in step S11.

In step S12, a determination is made based on the result of the comparison executed in step S11 as to whether the first and second pitch data sets detected by the first pitch detection section 13 and the second pitch detection section 15 are equal to each other within a specified range. When the first and second pitch data sets detected by the two pitch detection sections 13 and 15 are equal to each other within the specified range, a determination "Yes" is made, and the process proceeds to step S13. When the first and second pitch data sets are not equal to each other within the specified range, a determination "No" is made, and the process proceeds to step S19 or step S21.

In step S13, one of the pitch data sets that is determined to be equal to the other is defined as a confirmed pitch data set, and a control signal for controlling parameters, including tone color and the like, of a tone is generated based on the confirmed pitch data set. In step S14, a tone control data set for commanding tone color and the like is outputted to the tone generation section 17 or the signal processing section 19 in accordance with the picking position data provided by the picking position determination section 45.

Next, a determination is made in step S15 whether a note-off event occurs. The note-off determination is made by determining whether both outputs of the two pickup devices 2 and 3 are lower than a predetermined level. When both of the outputs of the two pickup devices 2 and 3 are lower than the predetermined level, a determination "Yes" is made, and a note-off process is executed in step S16. Further, in step S17, an operation member process is executed to control tones based on signals provided by the group of operation members 25 that may be operated by a performer. In step S18, a MIDI process is executed so that control data for generating and controlling tones is supplied to the MIDI converter section 18.

When both of the outputs of the two pickup devices 2 and 3 are not lower than the predetermined level, a note-off determination is not made. Accordingly, the process in step S16 is skipped and the process in step S17 is executed.

When a determination is made in step S12 that the first and second pitch data sets detected by the first pitch detection section 13 and the second pitch detection section 15 are not equal to each other within the specified range, and when the speed priority mode is selected, the process proceeds to step S19. In step S19, a previously confirmed pitch data set is compared with the first pitch data detected by the first pitch detection section 13, and the previously confirmed pitch data is also compared with the second pitch data detected by the second pitch detection section 15. Then, a result of the process executed in step S19 is used in step S20. In step S20, one of the first pitch data set and the second pitch data set that is closer to the previously confirmed pitch data set is selected as a confirmed pitch data set, and a tone control signal for controlling tones is generated based on the confirmed pitch data set. The method used in selecting the confirmed pitch data set in step S20 is adapted because of the following reasons. Among erroneous pitch detections in an electronic stringed instrument such as an electric guitar or a guitar synthesizer, a tone is often erroneously detected by a difference of one octave. However, there is substantially no occasion in which a change in the currently detected pitch of a vibrating string exceeds more than an octave from a previously detected pitch. This is why one of the first pitch data set and the second pitch data set that is closer to the previously confirmed pitch is selected as a confirmed pitch data set.

After the process in step S20 is executed, the processes in step S14 and in the succeeding steps are executed.

When the pitch data sets detected by the two pitch detection devices in step S12 are not equal to each other within a specified range, and the precision priority mode is selected, the process proceeds to step S21. In step S21, a determination is made as to whether next pitch data sets are inputted. When a first pitch data set provided by the first pitch detection section 13 and a second pitch data set provided by the second pitch detection section 15 are inputted, a determination "Yes" is made. In step S22, the newly inputted pitch data sets are compared with pitch data sets that have been inputted for the last several cycles up to the present moment.

A determination is made in step S23 as to whether the newly inputted pitch data sets are equal to any one of the pitch data sets that have been inputted for the last several cycles up to the present moment. When one of the newly inputted pitch data sets is equal to one of the previously inputted pitch data sets, a determination "Yes" is made. In step S24, the newly inputted pitch data set that is equal to one of the previously inputted pitch data sets is defined as a confirmed pitch data set, and a tone control signal for controlling tones is generated based on the confirmed pitch data set. Then, the processes in step S14 and in the succeeding steps are executed.

When next pitch data sets are not inputted, a determination "No" is made in step S21. The process in step S21 is repeated until next pitch data sets are inputted. When a determination is made in step S23 that one of the newly inputted pitch data sets does not concur with any one of pitch data sets that have been inputted for the last several cycles up to the present moment, the process returns to step S21 and the processes in step S21 through step S23 are repeated until one of the newly inputted pitch data sets concur with any one of pitch data sets that have been inputted for the last several cycles up to the present moment.

When the process in step S18 is completed, the process returns to step S10, and the processes in the succeeding steps are repeatedly executed.

In another embodiment, in step S12, when two detected pitches are within a specified range, an average value of the two pitches is calculated and the average value is defined as a confirmed pitch. Alternatively, when two detected pitches are within a specified range, a pitch detected based on an electrical signal provided by the first pickup device 2 may be defined as a confirmed pitch. This is because a pitch detected by the first pickup device 2 that is located far from the bridge 4 generally contains fewer overtone components and the probability of an erroneous pitch detection is lower.

In the above embodiment, an electronic stringed instrument is described with reference to a guitar synthesizer. The present invention is not limited to such an embodiment and is applicable to any type of electronic musical instrument having strings.

In one embodiment, magnetic type pickup devices that are generally used in electric guitars are used for the first pickup device 2 and the second pickup device 3. Instead of magnetic type pickup devices, piezoelectric pickup devices can also be used.

In another embodiment, tone colors and other parameters may be controlled in response to one of the first pickup device 2 and the second pickup device 3 which provides a key-on event earlier than the other.

In accordance with the embodiments of the present invention described above, positions at which strings are picked are determined and tones are controlled based on the determined picking positions. Accordingly, tone variation that is caused by picking a string at different locations is reflected in the tone control. As a result, tone color is varied depending on locations at which the string is picked.

Also, in accordance with the embodiments of the present invention described above, pitch data sets are detected based on corresponding respective electrical signals provided by at least two pickup devices, and a pitch is determined based on the two pitch data sets. As a result, the deficiencies of the conventional pitch detection methods are substantially eliminated and correct, prompt pitch detection is enabled.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. An electronic stringed instrument including at least one string, the electronic stringed instrument comprising:

at least two pickup devices provided for the at least one string, the at least two pickup devices for detecting vibration of the at least one string at two locations and converting the vibration to at least two electric signals;

a phase difference detection device that detects a phase difference between the electric signals outputted by the at least two pickup devices; and a musical sound controlling device that controls a tone based on the phase difference detected by the phase difference detection device.

2. An electronic stringed instrument as defined in claim 1, further comprising:

at least one pitch detection device coupled to each of the at least two pickup devices, the pitch detection devices detecting pitches of the vibration based on the electric signals outputted from the at least two pickup devices and generating pitch data sets representative of the respective pitches;

a pitch determination device that makes a comparison between the two pitch data sets and determines a correct pitch data set based on the comparison; and a tone generation device that generates a tone based on the phase difference detected by the phase difference detection device and the correct pitch data set determined by the pitch determination device.

3. An electronic stringed instrument as defined in claim 2, wherein the pitch determination device determines each of the pitch data sets as a correct pitch data set when the two pitch data sets concur with each other and determines one of the pitch data sets as a correct pitch data set based on a predetermined condition in which the at least two pickup devices are disposed with respect to the at least one string when the two pitch data sets do not concur with each other.

4. An electronic stringed instrument as defined in claim 1, wherein the at least one string defines a picking area extending between the at least two pickup devices, and the at least two pickup devices detect vibration of the at least one string when the at least one string is picked within the picking area.

5. An electronic stringed instrument as defined in claim 4, further comprising at least two pitch detection devices that detect pitches of the vibration based on the electric signals outputted by the at least two pickup devices and generate pitch data sets representative of the respective pitches;

a pitch determination device that determines one of the pitch data sets as a correct pitch data set under a predetermined condition; and a tone generation device that generates a tone based on the phase difference detected by the phase difference detection device and the correct pitch data set determined by the pitch determination device.

6. An electronic stringed instrument including at least one string, the electronic stringed instrument comprising:

at least two pickup devices provided for the at least one string that detect vibration of the at least one string at two locations and convert the vibration to at least two electric signals;

at least two pitch detection devices that detect at least two pitches based on the at least two electric signals outputted by the at least two pickup devices and generate at least two pitch data sets respectively representative of the at least two pitches; and a pitch determination device that determines each of the pitch data sets as a correct pitch data set when the at least two pitch data sets are equal to each other, and determines one of the at least two pitch data sets as a correct pitch data set under a predetermined condition in which the at least two pickup devices are disposed with respect to the at least one string when the at least two pitch data sets are not equal to each other; and a tone generating device that generates a tone in accordance with the correct pitch data set.

7. An electronic stringed instrument including a bridge, a nut, and at least one string extending between the bridge and the nut, the electronic stringed instrument comprising:

a first pickup device and a second pickup device spaced at a predetermined distance from the first pickup device for detecting vibration of the at least one string at two separated locations when the at least one string is picked at a picking location between the first pickup device and the second pickup device and converting the vibration of the at least one string to two electric signals;

a time difference detection device that detects a time difference between the two electric signals outputted by the first pickup device and the second pickup device; and a musical sound controlling device that controls a tone based on the time difference detected by the time difference detection device.

8. An electronic stringed instrument as defined in claim 7, further comprising:

two pitch detection devices respectively coupled to the two pickup devices, the two pitch detection devices for detecting two pitch data sets based on the respective electric signals outputted from the two pickup devices;

a pitch determination device that makes a comparison between the two pitch data sets and determines a correct pitch data set based on the comparison; and a tone generation device that generates a tone based on the time difference detected by the time difference detection device and the correct pitch data set determined by the pitch determination device.

9. An electronic stringed instrument as defined in claim 8, wherein the bridge is located closer to the second pickup device than the first pickup device, and wherein the pitch determination device determines one of the pitch data sets representative of one of the electric signals provided by the first pickup device as a correct pitch data set when a pitch difference between the two pitch data sets is within a predetermined pitch range and determines one of the pitch data sets representative of one of the electric signals provided by the first pickup device as a correct pitch data set when the two pitch data sets do not concur with each other.

10. An electronic stringed instrument as defined in claim 8, wherein the bridge is located closer to the second pickup device than the first pickup device, and wherein the pitch determination device determines each of the pitch data sets as a correct pitch data set when the two pitch data sets concur with each other and determines one of the pitch data sets representative of one of the electric signals provided by the first pickup device as a correct pitch data set when the two pitch data sets do not concur with each other.

11. A method of operating an electronic stringed instrument including at least one string, the method comprising the steps of:

detecting vibration of the at least one string at two locations;

converting the vibration to at least two electric signals;

detecting a phase difference between the at least two electric signals; and generating a tone based on the phase difference.

12. A method as defined in claim 11, further comprising the steps of:

detecting pitches of the vibration based on the at least two electric signals;

generating pitch data sets representative of the respective pitches;

making a comparison between the two pitch data sets and determining a correct pitch data set based on the comparison; and generating a tone based on the phase and the correct pitch data set.

13. A method as defined in claim 12, wherein each of the pitch data sets is determined as a correct pitch data set when the two pitch data sets concur with each other and one of the pitch data sets is determined as a correct pitch data set under a predetermined condition in which the at least two pickup devices are disposed with respect to the at least one string when the two pitch data sets do not concur with each other.

14. A method as defined in claim 12, wherein one of the pitch data sets is determined as a correct pitch data set under a predetermined condition in which the at least two pickup devices are disposed with respect to the at least one string when a difference between the two pitch data sets exceeds a predetermined range.

15. A method as defined in claim 12, wherein an average value of the pitch data sets is determined as a correct pitch data set when a difference between the two pitch data sets is within a predetermined range and one of the pitch data sets is determined as a correct pitch data set under a predetermined condition in which the at least two pickup devices are disposed with respect to the at least one string when a difference between the two pitch data sets exceeds the predetermined range.

16. A method of operating an electronic stringed instrument including at least one string, the method comprising the steps of:

detecting vibration of the at least one string at two locations;

converting the vibration to at least two electric signals;

detecting at least two pitches based on the at least two electric signals;

generating at least two pitch data sets respectively representative of the at least two pitches;

making a comparison between the at least two pitch data sets and determining a correct pitch data set based on the comparison; and generating a tone based on the phase and the correct pitch data set.

17. A method as defined in claim 16, wherein each of the pitch data sets is determined as a correct pitch data set when the two pitch data sets concur with each other and one of the pitch data sets is determined as a correct pitch data set under a predetermined condition in which the at least two pickup devices are disposed with respect to the at least one string when the two pitch data sets do not concur with each other.

18. A method as defined in claim 16, wherein one of the pitch data sets is determined as a correct pitch data set under a predetermined condition in which the at least two pickup devices are disposed with respect to the at least one string when a difference between the two pitch data sets exceeds a predetermined range.

19. A method as defined in claim 16, wherein an average value of the pitch data sets is determined as a correct pitch data set when a difference between the two pitch data sets is within a predetermined range and one of the pitch data sets is determined as a correct pitch data set under a predetermined condition in which the at least two pickup devices are disposed with respect to the at least one string when a difference between the two pitch data sets exceeds the predetermined range.

20. A method of operating an electronic stringed instrument including a bridge, a nut, and at least one string extending between the bridge and the nut, the method comprising the steps of:

detecting vibration of the at least one string at a first location and a second location separated from the first location when the at least one string is picked at a picking location between the first location and the second location;

converting the vibration of the at least one string to two electric signals;

detecting a time difference between the two electric signals; and generating a tone based on the time difference.

21. A method as defined in claim 20, further comprising the steps of:

detecting two pitch data sets based on the respective two electric signals;

making a comparison between the two pitch data sets and determining a correct pitch data set based on the comparison; and generating a tone based on the time difference and the correct pitch data set.

22. A method as defined in claim 21, wherein the bridge is located closer to the second location than the first location, and wherein one of the pitch data sets representative of one of the electric signals detected at the first location is determined as a correct pitch data set when the two pitch data sets do not concur with each other.

23. A method as defined in claim 21, wherein an average value of the pitch data sets is determined as a correct pitch data set when a difference between the two pitch data sets is within a predetermined range and one of the pitch data sets is determined as a correct pitch data set under a predetermined condition in which the at least two pickup devices are disposed with respect to the at least one string when a difference between the two pitch data sets exceeds the predetermined range.

24. A machine-readable media storing instructions for causing an electronic stringed instrument including at least one string to perform a method of generating tones, the method comprising the steps of:

detecting vibration of the at least one string at two locations;

converting the vibration to at least two electric signals;

detecting a phase difference between the at least two electric signals; and generating a tone based on the phase difference.

25. A machine-readable media as defined in claim 24, wherein the method further comprises the steps of:

detecting pitches of the vibration based on the at least two electric signals;

generating pitch data sets representative of the respective pitches;

making a comparison between the two pitch data sets and determining a correct pitch data set based on the comparison; and generating a tone based on the phase and the correct pitch data set.

26. A machine-readable media as defined in claim 25, wherein each of the pitch data sets is determined as a correct pitch data set when the two pitch data sets concur with each other and one of the pitch data sets is determined as a correct pitch data set under a predetermined condition in which the at least two pickup devices are disposed with respect to the at least one string when the two pitch data sets do not concur with each other.

27. A machine-readable media as defined in claim 25, wherein one of the pitch data sets is determined as a correct pitch data set under a predetermined condition in which the at least two pickup devices are disposed with respect to the at least one string when a difference between the two pitch data sets exceeds a predetermined range.

28. A machine-readable media as defined in claim 25, wherein an average value of the pitch data sets is determined as a correct pitch data set when a difference between the two pitch data sets is within a predetermined range and one of the pitch data sets is determined as a correct pitch data set under a predetermined condition in which the at least two pickup devices are disposed with respect to the at least one string when a difference between the two pitch data sets exceeds the predetermined range.

* * * * *